US005169351A

United States Patent [19]

Choi

[11] Patent Number: 5,169,351

[45] Date of Patent: Dec. 8, 1992

[54] SHADOW MASK HEATING APPARATUS FOR COLOR CRT OF THE FLAT FACEPLATE TYPE

[75] Inventor: Sang-sin Choi, Auyang, Rep. of Korea

[73] Assignee: Samsung Electron Devices Co., Ltd., Kyunggi, Rep. of Korea

[21] Appl. No.: 626,047

[22] Filed: Dec. 12, 1990

[30] Foreign Application Priority Data

Dec. 12, 1989 [KR] Rep. of Korea ..... 89-18411

[51] Int. Cl.[5] ..... H01J 9/00; F24J 3/00; H05B 3/68

[52] U.S. Cl. ..... 445/60; 432/225; 432/226; 392/435; 219/443; 445/68

[58] Field of Search ..... 445/30, 37, 60, 68; 432/10, 225, 226; 392/432, 435; 219/443, 524

[56] References Cited

U.S. PATENT DOCUMENTS 1,213,507 1/1917 Lawrence ..... 219/443
2,455,839 12/1948 Walton ..... 392/432
3,346,720 10/1967 Siegla ..... 219/443
4,772,238 9/1988 Horn et al. ..... 445/30

*Primary Examiner*—Richard K. Seidel
*Assistant Examiner*—Jeffrey T. Knapp
*Attorney, Agent, or Firm*—Cushman, Darby & Cushman

[57] ABSTRACT

A shadow mask heating apparatus for a color CRT of the flat faceplate type includes upper and lower heated platens, each provided with heating means therein. One of the platens includes a plurality of mask support elements having a predetermined height radially disposed in an equally spaced relation on the top surface. The mask support elements preferably consist of a plurality of long and short, in length, mask support element. A plurality of passages radially formed on the top surface result between the mask support element. A plurality of adjusting pins disposed on the peripheral area of the top surface thereof of the one platen keeps the two platens separated a precise distance. The arrangement of radially disposed mask support elements minimizes shadow mask deformation during manufacture.

4 Claims, 4 Drawing Sheets

SHADOW MASK HEATING APPARATUS FOR COLOR CRT OF THE FLAT FACEPLATE TYPE

FIELD OF THE INVENTION

The present invention relates to a shadow mask heating apparatus for a color cathode ray tube of the flat faceplate type, and, more particularly, to an improvement of such a heating apparatus capable of minimizing the deformation of a shadow mask due to nonuniform thermal expansion thereof and of enhancing the uniform thermal expansion of the shadow mask.

BACKGROUND OF THE INVENTION

In general, a color cathode ray tube of the flat faceplate type, as shown in FIG. 1, includes a flat type shadow mask S made of an apertured metallic foil, which is welded to a support frame T under a predetermined tension and located alongside the inner surface of a flat faceplate P sealed to a funnel F. Flat faceplate CRT's are manufactured as, for example, 9–21 inch CRT screens. The thin foil type shadow mask S cannot easily maintain its shape, (i.e., its planarity) because of processing difficulties.

The prior art process for fixing the above-mentioned shadow mask is summarized as follows:

I) Heating the shadow mask for the thermal expansion in a heating apparatus.

II) Clamping the thermally expanded shadow mask to a fixture frame (not shown);

III) Cooling the clamped shadow mask to room temperature, thereby creating tension in the mask to be taut and planar;

IV) Welding the shadow mask to the support structure adjacent to the inner surface of the faceplate; and V) Removing the fixture frame from the panel after trimming off the periphery of the shadow mask.

In the above-described steps, the shadow mask heating apparatus tends to thermally expand by heating the shadow mask. Clamping to the fixture frame by clip means provided on the fixture frame prevents the thermally expanded shadow mask from shrinking when subsequently cooled. In the taut state, the effective area of the shadow mask is welded to the support frame and finally trimmed to remove the fixture frame from the shadow mask.

In U.S. Pat. No. 4,772,238, there is disclosed a foil mask stretching apparatus 10, which is illustrated in FIGS. 3 and 4 of the present invention drawings. The stretching apparatus illustrated in FIG. 3 comprises upper and lower heated platens 11 and 12, each having a heating element 13 located therein and made of heat resistant steel. A shadow mask S is located between the platens 11 and 12 to be heated for thermal expansion.

Migrant particles are shed from the clamping machine, the clothing of the operator or other nearby pollution sources. These particles may become trapped between or on the platens 11 and 12, the shadow mask S. Such particles can plug the shadow mask apertures and also dent the mask when it is heated. In order to prevent the shadow mask from being damaged by migrant particles, recesses 12*a* are formed on the lower platen 12 so that the migrant particles fall in the recesses 12*a*.

However, when the shadow mask is heated to be thermally expanded, it can sag into the recesses 12*a*. When the mask sags excessively into recesses 12*a*, the mask cannot maintain the required planarity, even after cooling, and thus the mask remains in a deformed state.

Excessive sagging is somewhat prevented by matrix type mask support elements 12*b* provided on the top surface of the lower platens 12 and also made of heat resistant steel. Mask support elements 12*b* define a plurality of square type recesses 12*a*.

For heating, the shadow mask S is inserted between the platens 11 and 12, and then a voltage is applied to the heating elements 13 incorporated in the platens 11 and 12. Accordingly, the heat produced from the heating elements 13 is transmitted via the platens 11 and 12 to heat the shadow mask S.

This heat is transmitted to the mask S over recesses 12*a* by indirect conduction such as convection and radiation. However, the temperature on the portions of the mask located immediately above each recess 12*a* is substantially lower than the portion in direct contact with the mask support element 12*b*. Because of this conduction, enhanced by the flat surface of mask support elements 12*b*, the whole surface of the mask is not uniformly heated and undesired distortions and deformations still occur.

SUMMARY OF THE INVENTION

Therefore, it is an object of the present invention to provide a shadow mask heating apparatus for a color cathode ray tube of the flat faceplate type through which a shadow mask having a high quality planarity is obtained by uniformly heating the shadow mask while minimizing the shadow mask deformation caused during a thermal expansion process.

To achieve the above object, the shadow mask heating apparatus for a color cathode ray tube of the flat faceplate type, in accordance with the present invention, includes upper and lower heated platens, One of the platens is provided with a plurality of heat transferring mask support elements having a predetermined height for maintaining more even heat distribution to the shadow mask. A plurality of adjusting pins are disposed on the peripheral area of the top surface to keep the other platen a predetermined distance from the shadow mask.

In one preferred embodiment, long mask support elements are radially disposed in an equally spaced relation on the top surface of the lower platen from the central portion toward marginal portion thereof. Short mask support elements are then disposed between the long mask support elements on the peripheral area of the lower platen.

Furthermore, the mask support elements are preferably triangularly shaped in cross-sectional dimension, with a edge being rounded. The adjusting pins are substantially higher than the mask support elements. Moreover, the upper and lower platens are preferably shaped to an elliptical configuration.

BRIEF DESCRIPTION OF THE DRAWINGS

The preferred embodiment of the present invention, and further objects and advantages thereof, may best be understood with reference to the following detailed description of the preferred embodiment taken in conjunction with the accompanying drawings, in which.

DETAILED DESCRIPTION OF THE PREFERRED EMBODIMENT

Figure 1:
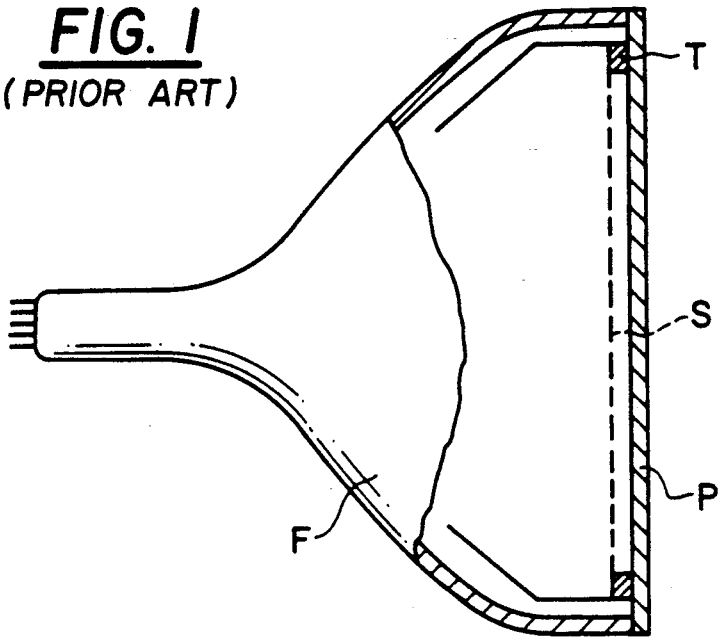
FIG. 1 (PRIOR ART)
FIG. 1 is a partially sectioned view of the Conventional color cathode ray tube of the wholly flat faceplate type.
Figure 2:
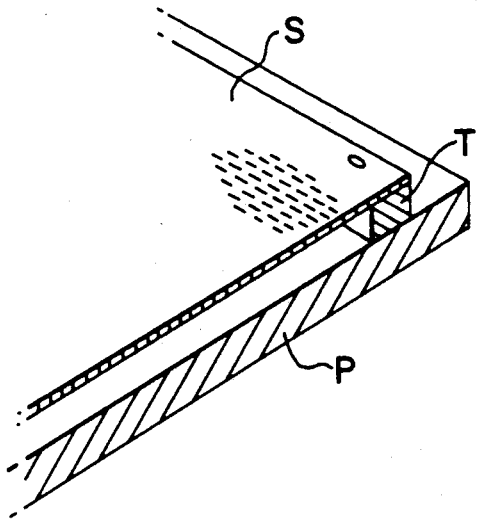
FIG. 2 (PRIOR ART)
FIG. 2 is an enlarged fragmentary perspective view showing a part of the flat faceplate of the color cathode ray tube depicted in FIG. 1.
Figure 3:
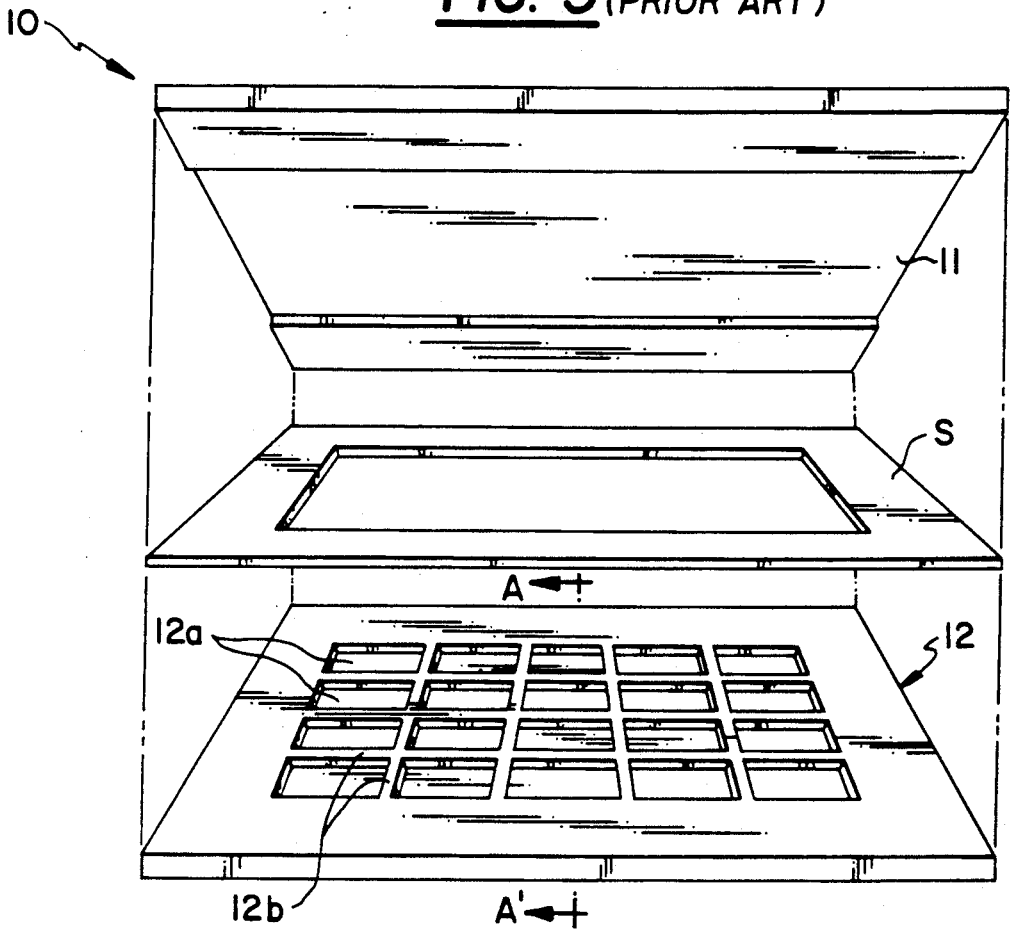
FIG. 3 (PRIOR ART)
FIG. 3 is an exploded view showing an upper platen and lower platen of the conventional shadow mask heating apparatus.
Figure 4:
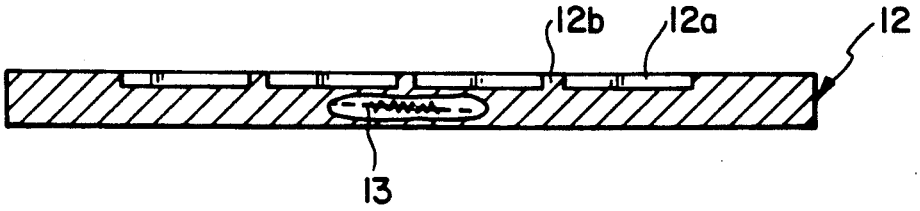
FIG. 4 (PRIOR ART)
FIG. 4 is a sectional view taken along lines A—A' in FIG. 3.
Figure 5:
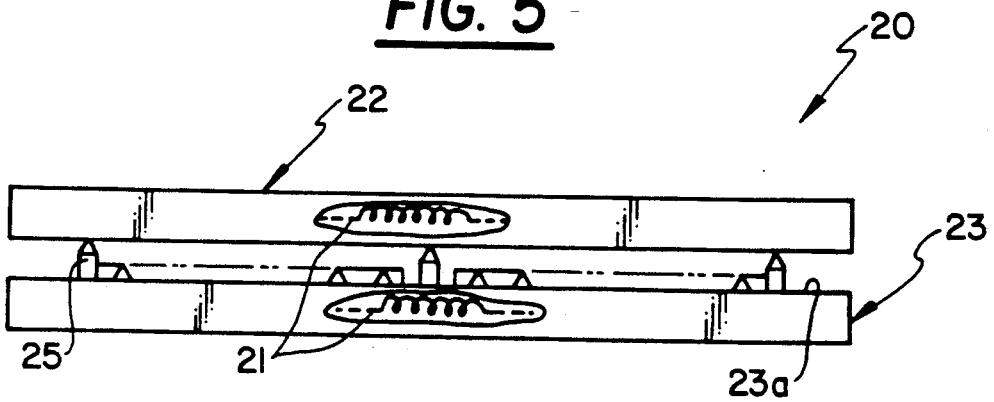
FIG. 5 is a side elevational view of a shadow mask heating apparatus for a color cathode ray tube of the flat faceplate type according to the present invention.
Figure 6:
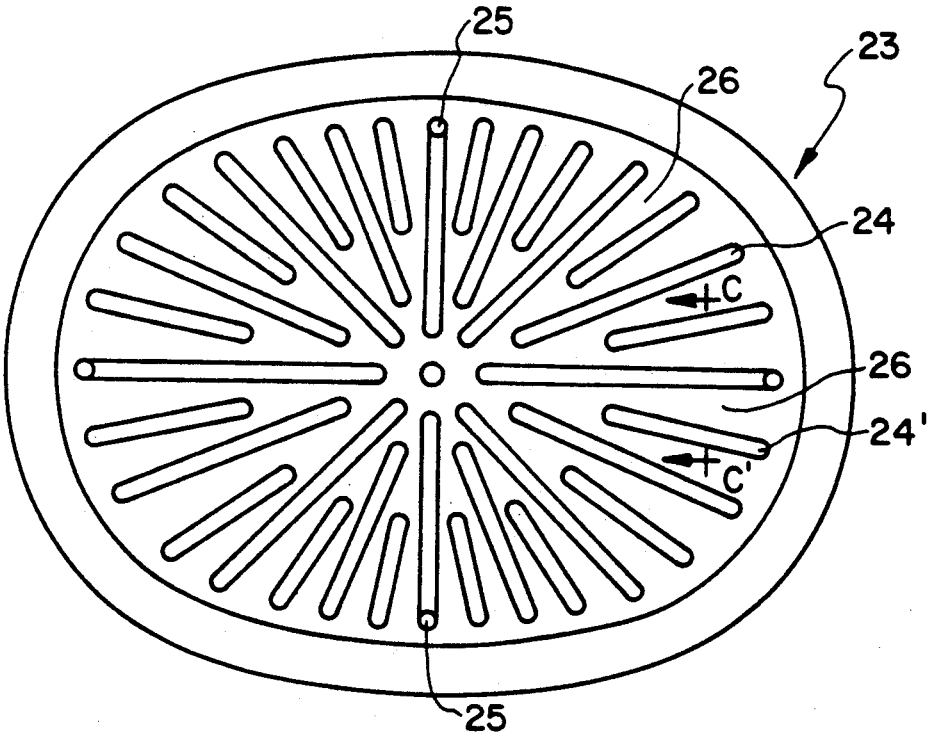
FIG. 6 is a plan view of a lower platen of the shadow mask heating apparatus according to the present invention.

FIGS. 5 and 6 illustrate a shadow mask heating apparatus 20 for a color cathode ray tube of the flat faceplate type, which comprises upper and lower heated platens 22 and 23, each having a heating means 21 disposed therein and made of heat resistant steel. The platens 22 and 23 are preferably shaped to an elliptical configuration.

The lower heated platen 23 is formed with a plurality of heat transferring mask support elements 24 and 24' preferably made of heat resistant steel and having a predetermined height on the top surface 23*a* which is preferably 0.5–1 mm in height above the top surface 23*a*. Long and short (in length) mask support elements 24 and 24' are radially disposed on the top surface 23*a* of the lower platen 23 in such a manner that the long mask support elements 24 are radically disposed from the central portion of the lower platen 23 toward the marginal portion thereof in an equally spaced relation, while short mask support elements 24' are interposed between two long mask support elements 24 in the peripheral area of the lower platen 23.

Passages 26 are thus provided in a radical relation between the mask support elements 24 or the mask support elements 24 and 24'.

Figure 7:
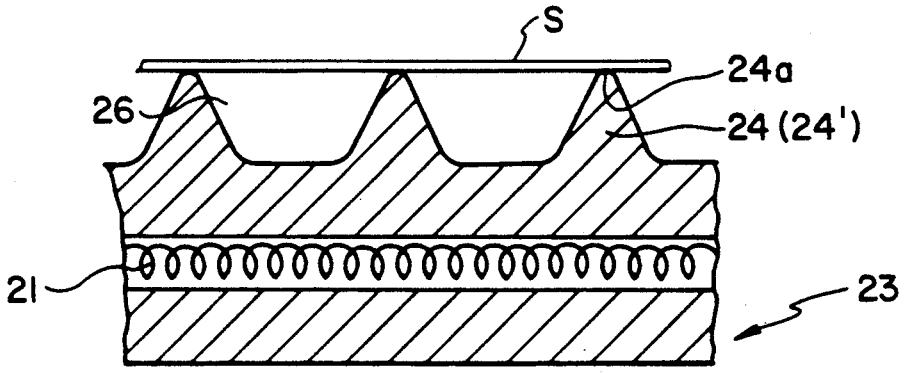
FIG. 7 is an enlarged fragmentary sectional view of the shadow mask heating apparatus depicted in FIG. 6.

Preferably, the cross-section of the mask support elements 24 and 24' is similar to a triangle, as illustrated in FIG. 7. An edge portion 24*a* along the top portion of the fins 24 and 24', and the edge portion 24*a* is chamfered to form a rounded shape.

In addition, a plurality of equally spaced adjusting pins 25 are disposed peripherally on the top surface 23*a* of the lower platen 23 such that the height of the adjusting pins 25 are constructed to be substantially higher than that of the mask support elements 24 and 24', preferably 1.0–2.0 mm above the sop surface 23*a* so that the upper and lower platens 22 and 23 are both equally spaced from the shadow mask S.

In operation, the upper and lower heated platens 22 and 23 are separately mounted into a hydraulic press or the like, and the shadow mask is inserted between the platens 22 and 23. A gap, typically about 1–2 mm between the upper and lower platens 22 and 23 is maintained by means of the adjusting pins 25 after the platens are brought to a closed state.

A voltage is then applied to the heating elements 13 incorporated in the upper and lower platens 22 and 23, to heat the shadow mask to about a temperature between 210–250 degrees Celsius and provide for thermal expansion. The shadow mask is in line contact with the edge portion 24*a* of the heating transferring mask support elements 24 and 24' radially disposed on the lower platen 23. This arrangement of mask support elements 24 and 24' prevents the shadow mask from sagging excessively.

In addition, since the long mask support elements 24 are radially disposed from the central portion while the short mask support elements 24' are disposed in the peripheral area of the lower platen 23 between the long fins 24, the distribution of the mask support elements 24 and 24' becomes uniform between the central and peripheral area of the lower platen 23. Moreover, the passages 26 formed between the mask support elements 24 and 24', transfer heat to the shadow mask by convection and radiation from the lower platen 23. The heat freely moves through the passages 26 because the radical arrangement and heat distribution becomes uniform. Thus, the shadow mask S is uniformly heated and deformation substantially prevented.

Figure 8:
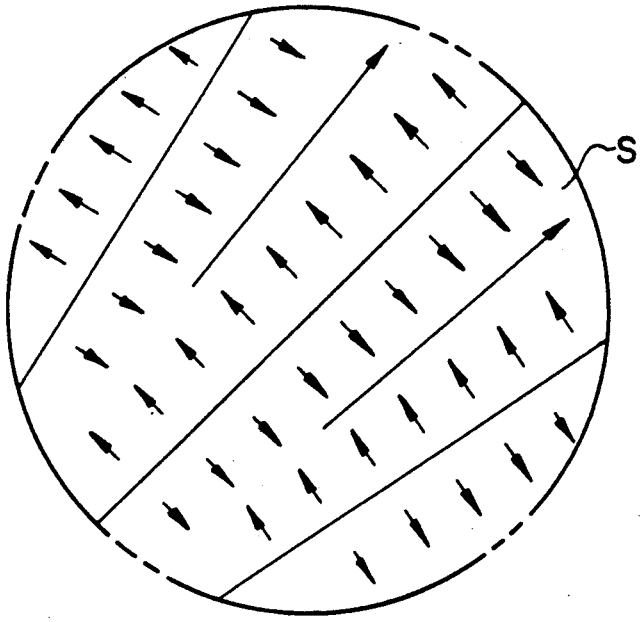
FIG. 8 is an enlarged fragmentary plan view showing the direction of the thermal expansion of the shadow mask heated by the heating apparatus depicted in FIG. 5.

It should also be noted that because mask supports 24 are arranged radially, the heat conduction, which is the primary heat transfer, occurs perpendicular to the radius of the platen 23, which results in the radial thermal expansion of the shadow mask without deformation or distortion, as illustrated in FIG. 8.

Migrant particles shed from the machine, the clothing of the operator, or the like, trapped between or on the upper and lower platens 22 and 23 and the shadow mask S fall in the passages 26. Thus, the shadow mask is not damaged from them.

As has been described in the foregoing, according to the present invention, the shadow mask is uniformly heated from the central portion to the peripheral portion. Thus, thermal deformation is prevented. Consequently, the shadow mask has uniform tension after subsequent cooling. When the shadow mask manufactured using a heating apparatus according to the present invention is mounted in the flat faceplate type color cathode ray tube, the performance of the color cathode ray tube is significantly enhanced.

Other changes and modifications may be made in the above-described apparatus without departing from the true spirit and scope of the invention and it is intended that above depiction shall be interpreted as illustrative and not in a limiting sense. The true spirit and scope of the present invention should be considered with reference to the accompanying claims.

What is claimed is:

1. A shadow mask heating apparatus for heating a shadow mask of a color cathode ray tube, said shadow mask heating apparatus including upper and lower heatable platens for heating the shadow mask, said lower heatable platen comprising:

a top surface having a center area and a periphery area; and a plurality of mask support elements disposed on said top surface for supporting the shadow mask during heating, said plurality of mask support elements having a predetermined height relative to said top surface and disposed along an equidistant radial direction from said center area to said periphery area of the top surface of said lower platen, said plurality of mask support elements being configured so as to provide for radially uniform thermal expansion of the shadow mask to be heated thereon, wherein said lower heatable platen further comprises a plurality of adjusting pins disposed along its periphery for maintaining the upper heatable platen at a fixed distance from the shadow mask during heating.

2. A shadow mask heating apparatus according to claim 1 wherein aid plurality of mask support elements comprise a first plurality of mask support elements arranged between a second plurality of mask support elements, each mask support element of said first plurality being longer than an adjoining pair of mask support elements from said second plurality.

3. A shadow mask heating apparatus according to claim 1 wherein said plurality of mask support elements are substantially triangular in shape along any given cross-section, each triangular shaped mask support element being rounded at a respective edge making contact with the shadow mask, thereby reducing distortion of the shadow mask from heating.

4. A shadow mask heating apparatus according to claim 1, wherein both said upper and lower platens are shaped in an elliptical configuration.

* * * * *